US008813991B1

(12) United States Patent
Liu

(10) Patent No.: US 8,813,991 B1
(45) Date of Patent: Aug. 26, 2014

(54) CONTAINER COVER

(71) Applicant: Free-Free Industrial Corp., Taipei (TW)

(72) Inventor: Sheng-Yu Liu, Taipei (TW)

(73) Assignee: Free-Free Industrial Corp., Taipei (TW)

( * ) Notice: Subject to any disclaimer, the term of this patent is extended or adjusted under 35 U.S.C. 154(b) by 0 days.

(21) Appl. No.: 13/786,668

(22) Filed: Mar. 6, 2013

(51) Int. Cl.
*B65D 53/02* (2006.01)
*B65D 41/18* (2006.01)
*B65D 51/00* (2006.01)

(52) U.S. Cl.
CPC ..... *B65D 51/00* (2013.01)
USPC ..... 220/378; 220/377; 220/784; 220/780

(58) Field of Classification Search
USPC ..... 220/377, 780, 795, 378, 784
See application file for complete search history.

(56) References Cited

U.S. PATENT DOCUMENTS

| | | | | | |
|---|---|---|---|---|---|
| 2,116,421 | A * | 5/1938 | Williams | ..... | 215/276 |
| 4,830,216 | A * | 5/1989 | Miyauchi | ..... | 220/377 |
| 5,791,506 | A * | 8/1998 | Sheffler et al. | ..... | 215/345 |
| 5,868,273 | A * | 2/1999 | Daenen et al. | ..... | 220/795 |

* cited by examiner

*Primary Examiner* — Fenn Mathew
*Assistant Examiner* — James N Smalley
(74) *Attorney, Agent, or Firm* — Sheridan Ross P.C.

(57) ABSTRACT

A container cover includes a cover plate, an annular frame and an annular gasket. The frame includes an annular surrounding wall and an annular flange. The surrounding wall extends substantially in a vertical direction, and is disposed outwardly of the cover plate to surround the cover plate. The surrounding wall cooperates with a peripheral surface of the cover plate to define a gap therebetween. The flange extends integrally and inwardly from the surrounding wall to contact an upper surface of the cover plate and to seal off one end of the gap. The gasket is disposed between the surrounding wall and the peripheral surface of the cover plate to fill the gap. The cover plate, the frame and the gasket are molded as one piece.

10 Claims, 2 Drawing Sheets

CONTAINER COVER

BACKGROUND OF THE INVENTION

1. Field of the Invention

The invention relates to a container cover, more particularly to a container cover adapted for hermetically sealing a container body.

2. Description of the Related Art

A conventional sealable container generally includes a container body, and a container cover capable of hermetically sealing an opening of the container body. For achieving the "hermetic" effect, an annular groove is usually provided directly in a bottom surface of the container cover for a gasket to be embedded therein. Though this configuration enables positioning of the gasket, gaps between the gasket and the container cover still exist. Liquid or powders can easily enter and accumulate in the gaps, making the gasket dirty and possibly causing contamination of contents stored in the conventional sealable container. Thus, in order to properly clean the gasket and the groove, the gasket has to be frequently removed from the container cover and assembled back together after being dried, causing the user inconvenience.

SUMMARY OF THE INVENTION

Therefore, the object of the present invention is to provide a container cover adapted for hermetically sealing a container body and having an improved structure to eliminate the drawbacks associated with the prior art.

According to the present invention, there is provided a container cover including a cover plate, an annular frame and an annular gasket.

The cover plate has upper and lower surfaces that are opposite to each other in a vertical direction, and a peripheral surface that interconnects the upper and lower surfaces.

The frame includes an annular surrounding wall and an annular flange. The surrounding wall extends substantially in the vertical direction, and is disposed outwardly of the cover plate to surround the cover plate. The surrounding wall cooperates with the peripheral surface of the cover plate to define a gap therebetween. The flange extends integrally and inwardly from the surrounding wall to contact the upper surface of the cover plate and to seal off one end of the gap.

The gasket is made from a resilient material and is disposed between the surrounding wall of the annular frame and the peripheral surface of the cover plate to fill the gap.

The cover plate, the frame and the gasket are molded as one piece.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
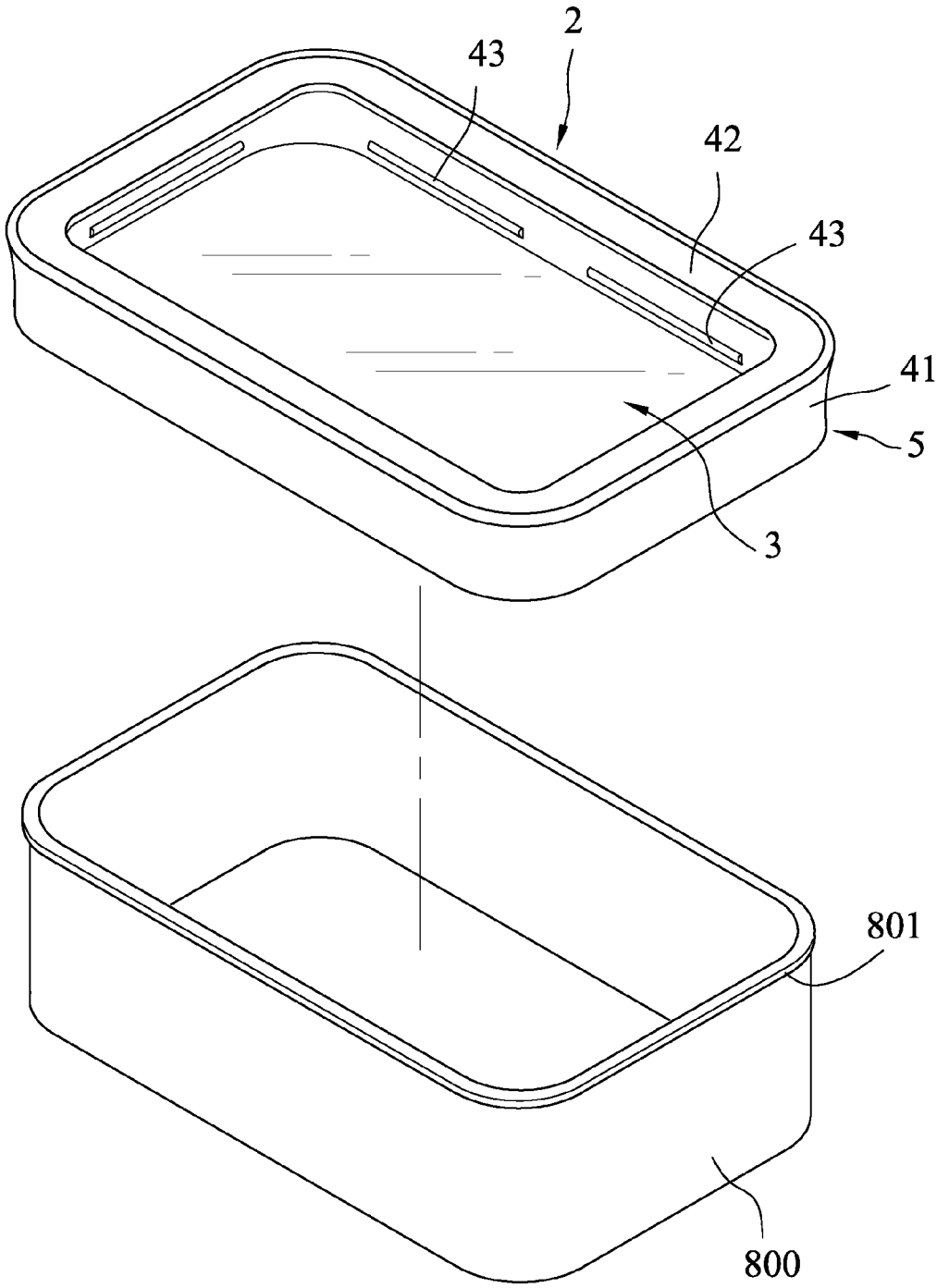
FIG. 1 is an exploded perspective view of the preferred embodiment of a container cover according to the present invention, and a container body to be hermetically sealed thereby when in use.
Figure 2:
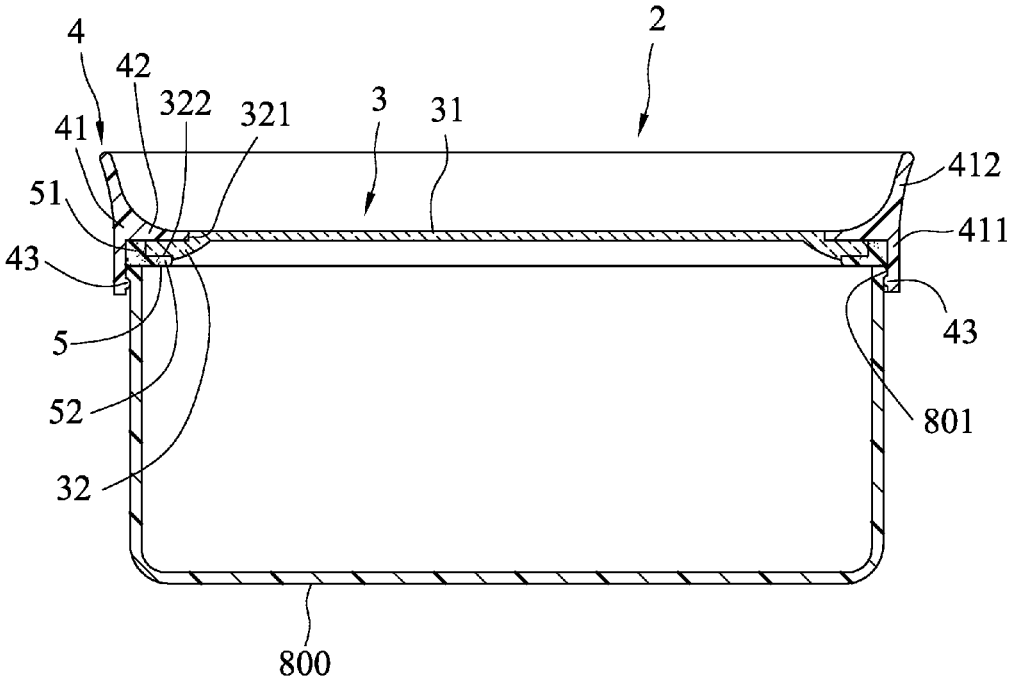
FIG. 2 is a side sectional view of the preferred embodiment and the container body sealed by the preferred embodiment.

Referring to FIGS. 1 and 2, the preferred embodiment of a container cover 2 according to the present invention is shown to be adapted for hermetically sealing a container body 800, and cooperates with the container body 800 to form a sealable container. The container cover 2 is to be engaged with an annular rib 801 that protrudes outwardly from a surrounding wall of the container body 800. In practice, the container cover 2 may as well be pivotally connected to the container body 800 among other configurations, and since the feature of this invention does not reside here, details of the same will be omitted hereinafter.

The container cover 2 includes a cover plate 3, an annular frame 4, and an annular gasket 5.

The cover plate 3 has upper and lower surfaces that are opposite to each other in a vertical direction, and a peripheral surface that interconnects the upper and lower surfaces. In this embodiment, the cover plate 3 is integrally formed by a plastic material and is transparent. However, in practice, the cover plate 3 may be made of glass. The materials and transparency characteristics of the cover plate 3 are not limited to what is disclosed herein.

The frame 4 includes an annular surrounding wall 41 and an annular flange 42. The surrounding wall 41 extends substantially in the vertical direction, and is disposed outwardly of the cover plate 3 to surround the cover plate 3. The surrounding wall 41 cooperates with the peripheral surface of the cover plate 3 to define a gap therebetween. The flange 42 extends integrally and inwardly from the surrounding wall 41 to contact the upper surface of the cover plate 3 and to seal off one end of the gap. In this embodiment, the frame 4 is made of a plastic material and is not limited to what is disclosed herein.

The gasket 5 is made from a resilient material and is disposed between the surrounding wall 41 of the frame 4 and the peripheral surface of the cover plate 3 to fill the gap. The gasket 5 includes an annular outer gasket portion 51 and an annular inner gasket portion 52. The outer gasket portion 51 fills the gap, extends downwardly beyond the gap, and is fixedly connected to the surrounding wall 41 of the frame 4. The inner gasket portion 52 extends integrally and inwardly from the outer gasket portion 51 to be fixedly connected to the lower surface of the cover plate 3, and protrudes downwardly of the lower surface of the cover plate 3. The flange 42 of the frame 4 is fixedly connected to an upper surface of the outer gasket portion 51 and the upper surface of the cover plate 3. In this embodiment, the gasket 5 is made of silicone material. However, in practice, the gasket 5 may be made of rubber or a resilient plastic material.

Specifically, the cover plate 3 includes a flat center plate body 31, and a peripheral plate portion 32 extending integrally and outwardly from and surrounding the center plate body 31 and having a thickness in the vertical direction greater than that of the center plate body 31. The peripheral plate portion 32 of the cover plate 3 is formed with an annular upper groove 321 and an annular lower groove 322. The upper groove 321 extends inwardly from the peripheral surface and downwardly from the upper surface, and having the flange 42 of the frame 4 fixedly engaged therein. The lower groove 322 extends inwardly from the peripheral surface and upwardly from the bottom surface, and having the inner gasket portion 52 fixedly engaged therein.

The surrounding wall 41 of the frame 4 has a lower wall segment 411 and an upper wall segment 412. The lower wall segment 411 is fixedly connected to an outer surface of said outer gasket portion 51 opposite to the inner gasket portion 52. The upper wall segment 412 extends integrally and upwardly from the lower wall segment 411 beyond the cover plate 3, and cooperates with the cover plate 3 to define a space that permits another container body (not shown) to be stably positioned and stacked thereon. The flange 42 of the frame 4 is connected at a junction of the lower and upper wall segments 411, 412.

The frame 4 further includes a plurality of engaging projections 43 protruding integrally, inwardly and spacedly from the lower wall segment 411 and disposed below the gasket 5 in the vertical direction. Each of the engaging projections 43 is an elongated strip extending in a horizontal direction transverse to the vertical direction.

The cover plate 3, the frame 4, and the gasket 5 are molded into one piece through an injection molding process involving three materials. The cover plate 3 which is made of a first material is initially placed in a mold (not shown), in which the second material for forming the gasket 5 is injected to integrally surround the periphery of the cover plate 3, and then the integral piece of the cover plate 3 and the gasket 5 is placed into another mold (not shown) in which the third material for forming the frame 4 is injected to integrally surround the integral piece of the cover plate 3 and the gasket 5, thereby forming the container cover 2 in one piece. However in practice, the order and manner carrying out this process is not limited to what is disclosed herein.

By the structural design of integral formation of the cover plate 3, the frame 4 and the gasket 5, the container cover 2 of this invention is constructed as an integrated entity with no inherent gaps.

When the container cover 2 is mounted on the container body 800, the inner gasket portion 52 of the gasket 5 is placed on and tightly abuts against a top edge of the container body 800 while the engaging protrusions 43 are engaged with the annular engaging rib 801 of the container body 800 so as to hermetically seal the container body 800. Since the gasket 5 is molded with the cover plate 3 and the frame 4 as one piece, there are no inherent gaps, and thus the problem of entering of liquid or powders is completely eliminated and the subsequent contamination therein is prevented. In addition, the user no longer needs to go through the tedious cleaning of the container cover involving disassembly and re-assembly of the gasket as with the prior art.

It should be noted herein that, when the container cover 2 of the present invention is adapted to be connected to the container body 800 in a pivoting manner, the engaging protrusions 43 are dispensable. Moreover, in practice, it is not essential for the peripheral plate portion 32 of the cover plate 3 to have a greater thickness than the center plate body 31, and the entire cover plate 3 can have a constant thickness. Furthermore, the upper wall segment 412 of the surrounding wall 41 may also be omitted.

In summary, through the gapless integral coupling structure of the cover plate 3, the frame 4 and the gasket 5 of the container body 2, accumulation of liquid nor powders is no longer possible. Therefore the purpose of this invention is served.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A container cover comprising:

a cover plate having upper and lower surfaces that are opposite to each other in a vertical direction, and a peripheral surface that interconnects said upper and lower surfaces;

an annular frame including an annular surrounding wall that extends substantially in the vertical direction, and that is disposed outwardly of said cover plate to surround said cover plate and to cooperate with said peripheral surface of said cover plate to define a gap therebetween, and an annular flange that extends integrally and inwardly from said surrounding wall to contact said upper surface of said cover plate and to seal off one end of said gap;

an annular gasket made from a resilient material and disposed between said surrounding wall of said frame and said peripheral surface of said cover plate to fill said gap;

said gasket includes an annular outer gasket portion that fills said gap, that extends downwardly beyond said gap, and that is fixedly connected to said surrounding wall of said frame, and an annular inner gasket portion that extends integrally and inwardly from said outer gasket portion to be fixedly connected to said lower surface of said cover plate;

said flange of said frame is fixedly connected to an upper surface of said outer gasket portion and said upper surface of said cover plate;

said cover plate is formed with an annular upper groove extending inwardly from said peripheral surface and downwardly from said upper surface, said flange of said frame being fixedly engaged in said upper groove; and wherein said cover plate, said frame and said gasket are molded as one piece.

2. A container cover comprising:

a cover plate having upper and lower surfaces that are opposite to each other in a vertical direction, and a peripheral surface that interconnects said upper and lower surfaces;

an annular frame including an annular surrounding wall that extends substantially in the vertical direction, and that is disposed outwardly of said cover plate to surround said cover plate and to cooperate with said peripheral surface of said cover plate to define a gap therebetween, and an annular flange that extends integrally and inwardly from said surrounding wall to contact said upper surface of said cover plate and to seal off one end of said gap;

an annular gasket made from a resilient material and disposed between said surrounding wall of said frame and said peripheral surface of said cover plate to fill said gap;

said gasket includes an annular outer gasket portion that fills said gap, that extends downwardly beyond said gap, and that is fixedly connected to said surrounding wall of said frame, and an annular inner gasket portion that extends integrally and inwardly from said outer gasket portion to be fixedly connected to said lower surface of said cover plate;

said flange of said frame is fixedly connected to an upper surface of said outer gasket portion and said upper surface of said cover plate;

said cover plate is formed with an annular lower groove extending inwardly from said peripheral surface and upwardly from said bottom surface, said inner gasket portion being fixedly engaged in said lower groove; and wherein said cover plate, said frame and said gasket are molded as one piece.

3. The container cover as claimed in claim 2, wherein said inner gasket portion protrudes downwardly of said lower surface of said cover plate.

4. The container cover as claimed in claim 2, wherein:

said cover plate includes a flat center plate body, and a peripheral plate portion extending integrally and outwardly from and surrounding said center plate body and having a thickness in the vertical direction greater than that of said center plate body; and said upper and lower grooves are formed in said peripheral plate portion.

5. A container cover comprising:

a cover plate having upper and lower surfaces that are opposite to each other in a vertical direction, and a peripheral surface that interconnects said upper and lower surfaces;

an annular frame including an annular surrounding wall that extends substantially in the vertical direction, and that is disposed outwardly of said cover plate to surround said cover plate and to cooperate with said peripheral surface of said cover plate to define a gap therebetween, and an annular flange that extends integrally and inwardly from said surrounding wall to contact said upper surface of said cover plate and to seal off one end of said gap; an annular gasket made from a resilient material and disposed between said surrounding wall of said frame and said peripheral surface of said cover plate to fill said gap;

said gasket includes an annular outer gasket portion that fills said gap, that extends downwardly beyond said gap, and that is fixedly connected to said surrounding wall of said frame, and an annular inner gasket portion that extends integrally and inwardly from said outer gasket portion to be fixedly connected to said lower surface of said cover plate;

said flange of said frame is fixedly connected to an upper surface of said outer gasket portion and said upper surface of said cover plate;

said surrounding wall of said frame has a lower wall segment fixedly connected to an outer surface of said outer gasket portion opposite to said inner gasket portion, and an upper wall segment extending integrally and upwardly from said lower wall segment beyond said cover plate, said flange being connected at a junction of said upper and lower wall segments; and wherein said cover plate, said frame and said gasket are molded as one piece.

6. The container cover as claimed in claim 5, wherein said frame further includes a plurality of engaging projections protruding integrally, inwardly and spacedly from said lower wall segment and disposed below said gasket in the vertical direction.

7. The container cover as claimed in claim 6, wherein each of said engaging projections is an elongated strip extending in a horizontal direction transverse to the vertical direction.

8. The container cover as claimed in claim 1, wherein said cover plate is transparent.

9. The container cover as claimed in claim 2, wherein said cover plate is transparent.

10. The container cover as claimed in claim 5, wherein said cover plate is transparent.

* * * * *